United States Patent [19]

Johnson et al.

[11] Patent Number: 4,989,484

[45] Date of Patent: Feb. 5, 1991

[54] PUNCH AND STRIPPER ASSEMBLY

[75] Inventors: Gary E. Johnson; John T. Schneider, both of Ramsey; Nils E. Sundquist, Plymouth, all of Minn.

[73] Assignee: Mate Punch & Die Company, Anoka, Minn.

[21] Appl. No.: 233,735

[22] Filed: Aug. 19, 1988

[51] Int. Cl.[5] ..... B21D 45/08; B26D 7/06; B26D 7/18

[52] U.S. Cl. ..... 83/140; 83/143; 83/552; 83/136

[58] Field of Search ..... 83/140, 141, 142, 700, 83/684, 669, 602, 138, 632, 143–146, 552–549, 171, 139, 132, 133, 136, 137, 698

[56] References Cited

U.S. PATENT DOCUMENTS

| | | | |
|---|---|---|---|
| 3,296,905 | 1/1967 | Killaly | 83/140 |
| 3,335,627 | 8/1967 | Smeets | 83/140 |
| 3,527,130 | 9/1970 | Knehans | 83/552 X |
| 3,733,944 | 5/1973 | Dietrick et al. | 83/143 X |
| 4,134,319 | 1/1979 | Clark | 83/698 X |
| 4,156,377 | 5/1979 | Bracewell | 83/63.97 X |
| 4,206,667 | 6/1980 | Hirata et al. | 83/698 X |
| 4,240,314 | 12/1980 | Teeslink | 83/169 X |
| 4,375,774 | 3/1983 | Wilson et al. | 83/140 |
| 4,428,262 | 1/1984 | Vlahek | 30/358 X |
| 4,446,767 | 5/1984 | Wilson | 83/140 X |
| 4,457,196 | 7/1984 | Cody | 83/700 X |

*Primary Examiner*—Frank T. Yost
*Assistant Examiner*—Kenneth E. Peterson
*Attorney, Agent, or Firm*—James V. Harmon

[57] ABSTRACT

A punch assembly for a punch press is described which includes an external housing or sleeve having a punch slidably mounted therein with a spring such as a disc spring for yieldably biasing the punch toward one end of the sleeve and a removable stripper plate mounted on the sleeve in a position around the operating end of the punch. The punch is preferably keyed to the sleeve in more than one location and the stripper plate guides the punch by preventing rotation as well as lateral deflection. A retaining member such as a ring surrounds the stripper plate and can be manipulated manually, e.g. by rotating it, to enable the punch and stripper plate to be ejected by means of a spring.

9 Claims, 3 Drawing Sheets

PUNCH AND STRIPPER ASSEMBLY

FIELD OF THE INVENTION

The present invention relates to punching equipment used in a punch press or the like, and more particularly to a punching device of the type that has a stripper to assist in the removal of material from the punch.

BACKGROUND OF THE INVENTION

There has existed the need for a high speed punching assembly to be used with the higher speed turret punch presses. High operating speeds and the increased use of standard tooling have created problems for prior punching assemblies, particularly when they are used to notch or nibble a workpiece. In a notching or nibbling operation in which a large area needs to be removed, a punch of a smaller size than the area to be removed can be used to nibble the material out in small bites. This creates a substantial lateral pressure on the punch since the punch is being used on only one or two sides. In the prior punching assemblies, the punch holder travels up and down in the press turret during this side loading, causing galling, seizing and bell-mouthing of the turret. It is therefore a general object to reduce this kind of wear and the expensive rework or replacement of the turret by limiting wear to the internal parts of the punching assembly.

In addition, the lubrication of previous punching assemblies has been a hit or miss proposition. This has contributed to premature damage and replacement of parts. Moreover, prior tools have had a tendency to overheat. It is therefore an object to provide a more effective means for lubricating and cooling the punching assembly, particularly the operating end of the punch.

The high speed steel from which the punch is made, while excellent in high temperature and abrasion resistance, is quite fragile and susceptible to chipping and spalling at its cutting edge. It is therefore an objective to support the punch at the working end in two dimensions, namely, by supporting it against both lateral and rotary movement.

Thus, in prior punching assemblies, wear was excessive and too much time was required to remove and replace the punch in from the punch assembly. The general objectives of the invention are to reduce wear, provide finished parts of better quality, i.e., flatter sheets, less burrs, longer punch life, quicker punch changing with more reliable and trouble free operation.

Punch devices have been previously proposed that include an external housing or sleeve within which the punch itself slides during operation. It is also known to provide a removable stripper plate surrounding the punch tip as shown for example in U.S. Pat. No. 4,248,111. These prior devices have certain shortcomings. Stripper plates are time-consuming to remove and replace. They also require a special tool for the manipulation of several retaining members used for securing the stripper in place. It is therefore one object to provide a way of more quickly and easily removing and replacing the stripper plate and punch including a self-locking provision that automatically secures the stripper plate in place. Moreover, prior punches of the type having a stripper could be used only as a push-type punch and were not suited for use with a push-pull ram, i.e., one in which the punch is pushed downwardly into engagement with the work and is also pulled back on the return stroke.

In view of these and other deficiencies of the prior art, the present invention has the following more specific objectives and advantages:

(a) The provision of an improved punching assembly having a means for more quickly and easily removing and replacing the punch and stripper plate;

(b) The provision of a feature for automatically locking the stripper plate in place on any one of several preset angular positions about the punch axis assembly;

(c) Provision for more effectively lubricating internal parts;

(d) Provision for the above-noted features in a push-pull style punch suited for use in a push-pull type punch press or press brake;

(e) A provision that enables the stripper plate to guide the punch both laterally and about its axis for improving alignment and stability especially when notching and nibbling;

(f) A provision for cooling the operating end of the punch by causing air to flow over it;

(g) A provision enabling the stripper plate to be removed with a single quick movement of the hand and to be ejected automatically with a pop-out action;

(h) The provision of a single retaining member for holding the stripper plate securely in place so that by shifting the retaining member the punch and stripper plate can be removed and replaced in about 30 seconds;

(i) Provision for enabling the punch and stripper plate to be removed for replacement while keeping the rest of the punch assembly intact;

(j) Provision for producing an audible signal when the punch has been released and can be removed; and (k) Provision for making a length adjustment to compensate for punch length changes and the amount of punch penetration into the die.

These and other more detailed specific objects of the invention will be apparent in view of the following description setting forth but a few of the various ways in which the present invention can be accomplished in view of the accompanying description which illustrates the invention by way of example.

SUMMARY OF THE INVENTION

In accordance with the present invention, a punching assembly is provided. The punch assembly preferably includes a casing or sleeve in which a punch is mounted for longitudinal sliding movement. In accordance with one feature of the invention, a removable stripper plate is provided adjacent the operating end of the punch. The stripper plate includes a central opening for the punch that surrounds and guides its cutting end. The stripper plate is provided with one or more alignment members or keys adapted to fit within an axial keyway within the punch assembly. A retaining means is provided which extends over a portion of the stripper plate at times to keep the stripper within the assembly until it is released by moving the retaining element away from a locking position over the stripper. The stripper plate can be keyed to the sleeve in any known manner, e.g. by means of a key on either the stripper plate or sleeve extending into a longitudinally extending way in the other part or even if desired by means of radially extending pins or teeth that provide a sliding fit between the sleeve and the stripper plate, for convenience, herein referred to at times as being "keyed to the sleeve" and by this term is meant any known means for allowing the stripper plate to shift longitudinally but not radially with respect to the sleeve.

Provision is also preferably made for keying the sleeve itself to the punch press turret. In this way the sleeve is prevented from rotating about the axis of the punching assembly and the punch within the sleeve is prevented from rotating by being keyed to the stripper plate. It is by this provision for keying the sleeve and in turn the stripper plate that the lower or working end of the punch is held more effectively in alignment, thereby improving the precision of the punching operation and the life of the tool.

The punching assembly of the present invention is mounted in an opening provided in the turret of a punch press. The sleeve or casing of the punching assembly is preferably mounted for sliding movement within the opening in the press. In accordance with one preferred form of the invention, a first key means is provided for keying the sleeve within the turret opening to prevent sleeve rotation therein. The punch is slidably mounted in the sleeve for movement along a punch axis. At the lower end of the sleeve is mounted the stripper plate. An opening in the plate corresponds in shape to the shape of the punch and is sized to provide a sliding fit for the operating end of the punch. Since in the preferred form of the invention a second key means is provided for keying the stripper plate in the sleeve for preventing rotation of the stripper about the punch axis, the operating end of the punch is guided by the stripper plate in two dimensions simultaneously. Specifically, the stripper plate prevents rotation of the punch as well as lateral deflection of the operating end of the punch. As a result the operating end of the punch is more efficiently protected against damage during use and punching can be accomplished with greater precision.

In accordance with another feature of the invention, a shiftable, e.g. rotatable, retaining element is mounted on the sleeve adjacent to the stripper plate. The stripper plate is provided with at least one projection which is covered at times by the retaining element to hold the stripper plate in place, but by shifting the retaining element to an alternate position an opening is aligned with the projection on the stripper plate, allowing the stripper plate to be removed from the end of the sleeve. It is preferred that a spring be provided for spring-loading the stripper plate so that it is ejected as soon as the retaining element is moved to the releasing position. A punch retraction spring is provided within the sleeve for yieldably biasing the punch upwardly with respect to the sleeve.

In accordance with another feature of the invention, the punch is provided with three longitudinally spaced apart bearing surfaces including a first bearing surface between the bore of the sleeve and a tang at the top of the punch assembly, a second bearing surface between the bore of the sleeve and a mating portion of the punch and a third bearing surface between the stripper plate and the operating end of the punch to thereby distribute loads, minimize wear on the punch and further improve operating precision.

In the preferred form of the invention, the punch is the push-pull type punch in which the sleeve or body of the punch is held stationary during punching. The punch retraction spring is mounted internally within the sleeve for achieving a positive stripping action.

In accordance with another feature of the invention, the stripper plate is removable and is automatically locked in place when inserted, i.e., it is self-locking.

In accordance with still another feature, the stripper plate is automatically ejected, i.e., it pops out when released.

Another feature of the invention is a provision for locating the stripper plate in any one of a number of selected angular positions about the axis of the punch, e.g., in any of eight positions.

Additional features of the invention relate to the provision of a punch retaining fastener that is held within the punch assembly at all times and is constructed to provide an audible click when the fastener is disengaged from the punch.

A further feature of the invention is a self-contained length adjustment means to compensate for changes in the length of the punch.

The invention will now be described by way of example with reference to the following figures.

THE FIGURES

FIG. 7 is a bottom view of the punch assembly with the punch and stripper plate removed and the locking ring locked in an open position.

FIG. 8 is a view similar to FIG. 7 showing the locking ring in position to hold the stripper plate in place, and FIG. 9 is a perspective view of the punching assembly showing the flow of oil and air.

DESCRIPTION OF A PREFERRED EMBODIMENT

Figures 1A, 1B, 1C, 2:
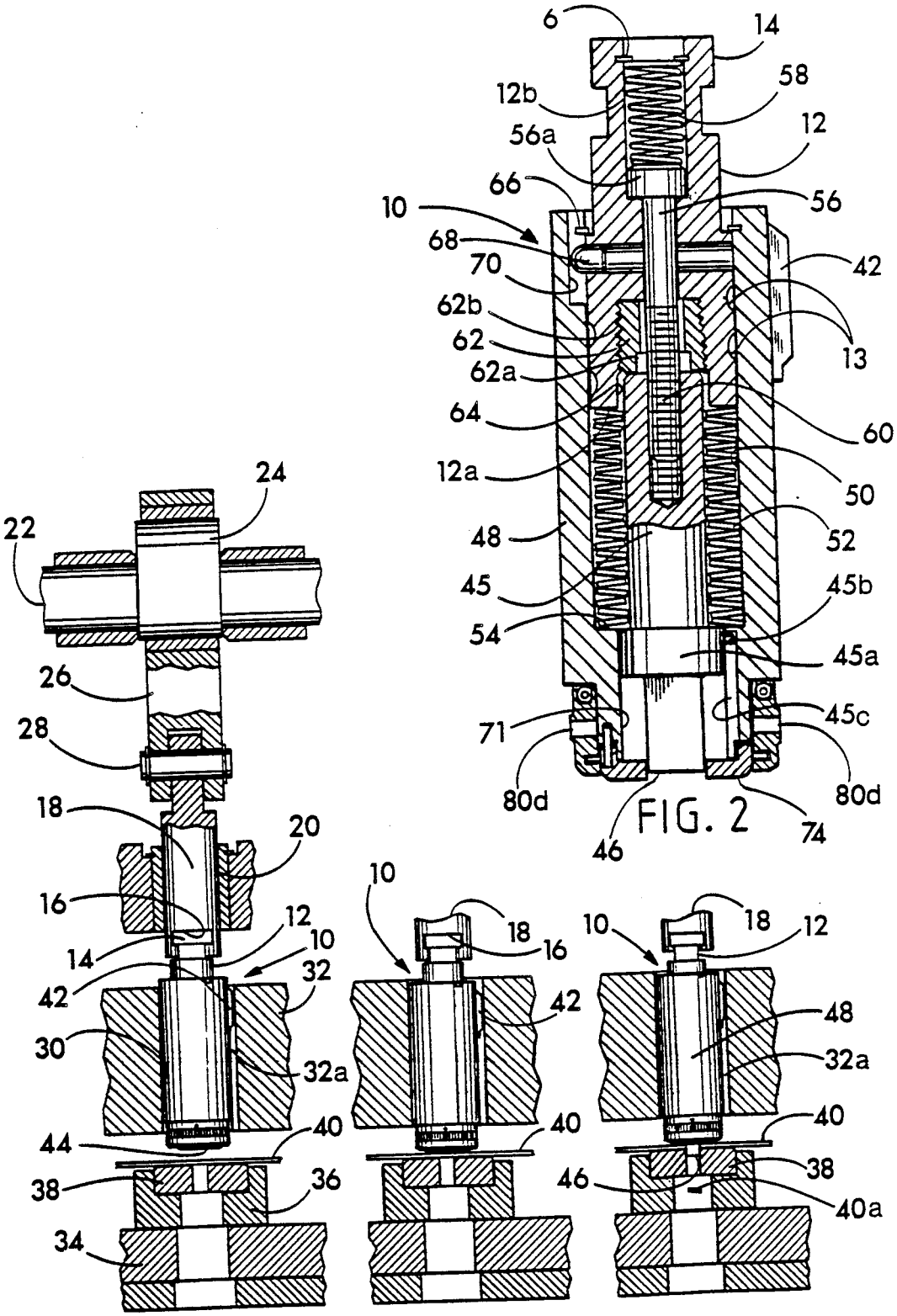
FIGS. 1A–1C is a vertical sectional views of a punch assembly and associated punch press mechanism during three sequential stages of operation.
FIG. 2 is a vertical cross-sectional view of the punch assembly.
Figure 3:
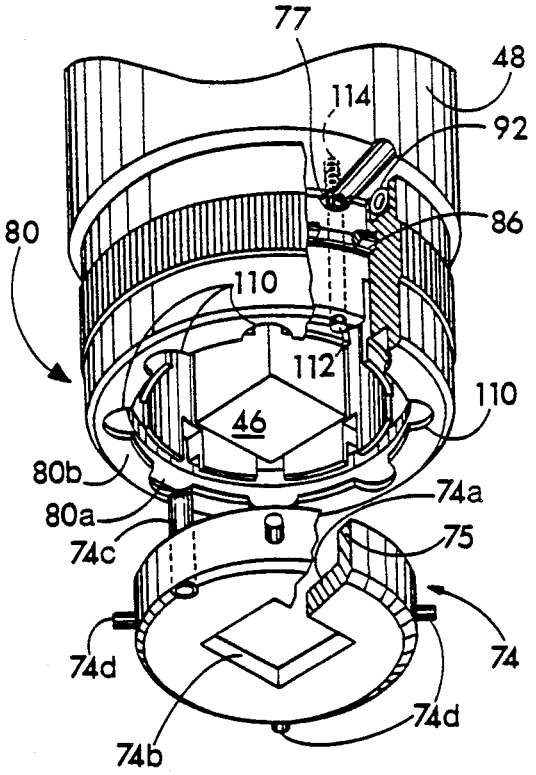
FIG. 3 is a perspective view of the lower end of the punch assembly with the stripper plate removed.

Refer now to the drawings, and more particularly to FIGS. 1A–1C and 2 which illustrate a punch assembly in accordance with the invention designated generally by the numeral 10. The punch assembly 10 includes a tang 12 having a T-shaped head 14 adapted to fit into a similarly shaped horizontally disposed slot 16 in a vertically disposed ram 18 mounted for vertical sliding movement within a vertical bearing 20. During operation, the ram is reciprocated by the rotation of a crankshaft 22 having eccentric 24 journaled for rotation within a pitman 26 that is connected to the ram 18 by means of a fulcrum pin 28. The punch assembly 10 is mounted for vertical sliding movement within a vertical bore 30 in the upper turret 32 of the punch press which also includes a lower turret 34 upon which is supported a die holder 36, die 38 and the workpiece 40. It will be seen that the upper turret 32 is provided with a vertically disposed keyway **32*a* and that the punch assembly 10 has secured to its outer surface an axially disposed, radially extending key 42 to keep the punch assembly from rotating in the bore 30, i.e., the key and keyway serve as a means for orienting the punch assembly and controlling its angular position about its center, namely, the axis of striding movement of the punch within the bore 30. It should be understood that the punch press including the upper and lower turrets 32, 34, the ram 18 and the crankshaft 22** are of well-known construction and commercially available.

From the description given it can be seen that the punch assembly 10 will be held against rotation within the bore 30 by the provision of the key 42 and keyway 32*a*. The T-connection at the top of the tang 12 permits the upper and lower turrets to move simultaneously in a horizontal plane for removing the T-head 14 from the slot 16 and introducing a different but similar punch and die assembly (not shown) so that when the T-head 14 of the new punch is introduced into the slot 16, punching can continue, usually with a punch of a different size or shape.

In the first stage of the punching operation in FIG. 1A, the punch assembly 10 is elevated so that a space exists above a workpiece 40. In the second stage, shown in FIG. 1B, the lower surface 44 of the punch assembly 10 contacts the workpiece 40. In the third stage of operation, the ram 18 continues to move downwardly as shown in FIG. 1C forcing the operating end or point 46 of a punch 45 outwardly while the outer portion or sleeve 48 of the punch assembly 10 remains stationary. As the point 46 of the punch is extended, the portion of a workpiece 40*a* beneath the punch is expelled through the die 38.

Refer now to FIG. 2 which illustrates the internal construction of the punch assembly 10. The punch assembly includes a cylindrical punch housing or sleeve 48 of ground and hardened steel having a central longitudinal bore 50 that encloses the punch 45 and a punch retraction spring assembly 52 which in this case comprises a stack of disc or Belville springs of annular configuration that during operation are compressed between a shoulder 54 at the bottom of the bore 50 and the lower surface 12*a* of the tang 12 for retracting the punch 45.

The punch 45 extends through the spring assembly 52 and is secured to the tang 12 by means of a drawbolt 56 having a head 56*a* countersunk in bore 12*b* and held in place at the bottom of the bore by means of a spring, in this case a helical ejection spring 58, the top end of which is secured within the countersunk bore 12*b* by means of a spring clip 6. The ejection spring 58 yieldably biases the drawbolt 56 downwardly and ejects the punch and stripper when released as will be further described below. The lower end of the drawbolt 56 is screw-threaded at 60 into the punch 45. Within the lower end of the tang 12 above the punch 45 for the purpose of adjusting the extension of the punch point 46, is a punch length adjustment platen or screw 62 having an allen wrench opening 62*a* at its lower end allowing it to be threaded up or down in the tang 12 by being screw-threaded at 62*b* within a bore 64 at the lower end of the tang 12. The tang itself is held in place at the top by means of a retaining ring 66 and is prevented from rotating within the bore 50 by being keyed therein, as for example by means of laterally extending key 68 extending into a longitudinally extending keyway 70.

An enlarged flange 45*a* near the lower end of the punch 45 is slidably received within a bore 71 at the lower end of the sleeve and can, if desired, be provided with a radially extending key or pin 45*b* that slides in a longitudinally extending keyway 45*c*.

Refer now to FIGS. 3–6. During operation, the operating end of a punch or punch point 46 is guided by means of a removable stripper plate 74. The stripper plate 74 is circular and, in this case, cup-shaped having an internal central recess 74*a* surrounding a punch opening 74*b* of the proper size to fit the punch point 46. The stripper plate 74 is provided with at least one extension but in this case four extensions in the form of laterally projecting pins 74*d* are used. In addition, an orientation means is provided comprising a longitudinally extending orientation pin 74*c*.

Figure 4:
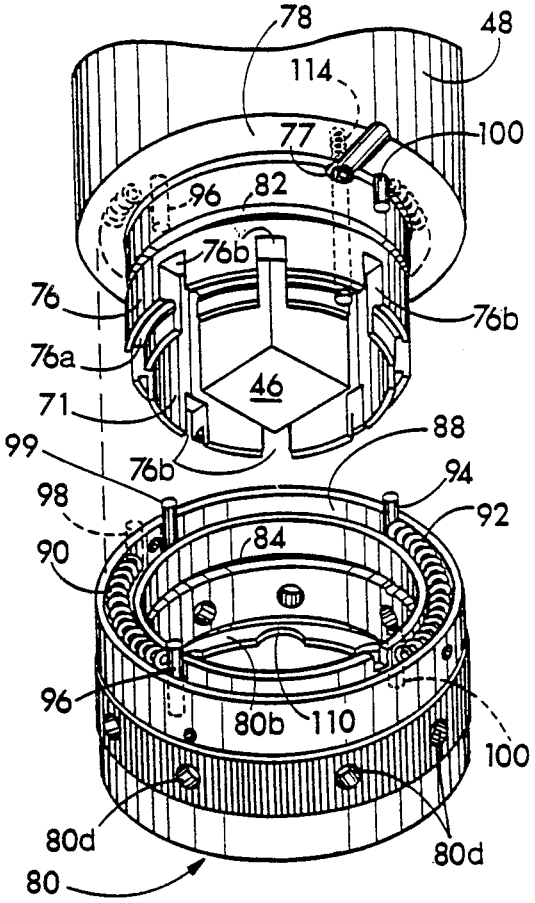
FIG. 4 is a perspective view of the lower end of the punch showing the locking ring as it appears when removed from the end of the punch sleeve.

As seen in FIG. 4, the lower end of the sleeve 48 is provided with a circular boss 76 surrounded by a downwardly facing shoulder 78 to receive a stripper plate retaining member or locking ring 80. Aligned, circumferentially extending grooves 82 and 84 are provided on the boss and on the locking ring 80 to receive a snap-ring 86 (FIG. 3) for holding the locking ring 80 in place after assembly. The locking ring 80 is provided with an upwardly facing circumferentially extending groove 88 to receive positioning springs 90 and 92 located within the groove 88 and positioned between a pair of diametrically opposed pins 94, 96 affixed to the locking ring 80 and a second pair of diametrically opposed pins 98 and 100 that are secured to the sleeve 48 and which for convenience of illustration are depicted by dotted lines in FIG. 4 as they would appear after the locking ring 80 has been mounted on the boss 76. Pin 99 is mounted in the locking ring 80 at a point spaced circumferentially from pin 98 so that as springs 90, 92 extend fully pin 99 will strike pin 98 and act as a stop to hold the locking ring 80 in the locked position.

As shown in FIG. 4, the boss 76 is hollow and is provided with a central bore 71 within which the flange 45*a* slides during operation. The boss 76 is also provided with an annular recess 76*a* at its lower end to receive an upwardly extending rim 75 at the edge of the stripper plate 74. As shown in FIG. 4, the boss 76 is also provided with a plurality of circumferentially spaced radial slots 76*b*, in this case there being four diametrically opposed pairs arranged at equal intervals of just the proper size to receive the longitudinally extending orientation pin 74*c* shown in FIG. 3. In this way the stripper plate 74 can be oriented in any one of eight radially spaced positions about the longitudinal axis of the punch assembly 10. Thus, with the plate opening 74*b* engaging the sidewalls of the operating end 46 of the punch 45, the stripper plate 74 will not only guide the punch longitudinally but will also maintain its proper angular position (e.g., one of eight positions can be selected) about the axis of the punch by placing the orientation pin 74*c* in one of slots 76*b*.

To hold the stripper plate in place, the locking ring 80 is undercut with centrally extending flanges 109 spaced apart by pin receiving slots 110 (FIGS. 3, 7 and 8) to cover the pins 74*d*. To remove or replace the stripper plate 74, the locking ring 80 is turned, i.e. shifted, about the axis of the punch assembly against the compression of the springs 90, 92 thereby aligning the pin receiving slots 110 with the pins 74*d* and allowing the stripper plate 74 to be removed and re-inserted. Then, by pushing the stripper in and depressing release pin 112, the springs 90, 92 rotate locking ring 80 on the boss 76 so that the flanges 109 cover the pins 74*d* thereby holding the stripper plate 74 securely in place on the end of the punch assembly 10.

Figure 5:
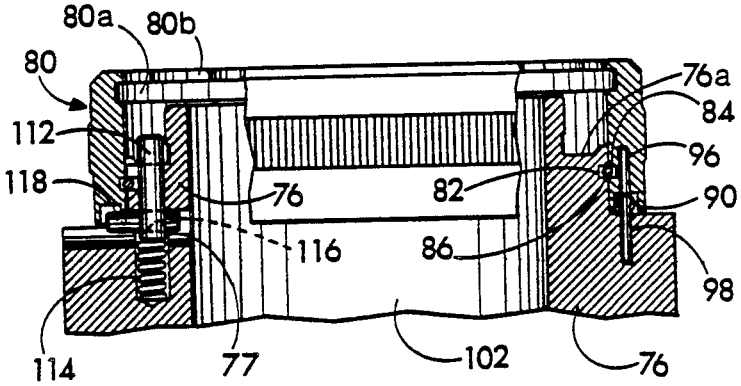
FIG. 5 is a partial cross-sectional view of the lower end of the punching assembly taken on line 5—5 of FIG. 7 with the locking ring locked in place.
Figure 6:
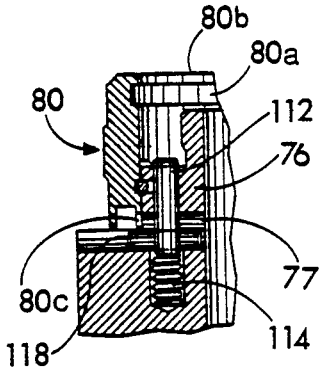
FIG. 6 is a partial view of the punching assembly as shown in FIG. 5 taken on line 6—6 of FIG. 8 with the locking ring unlocked.

The automatic stripper plate ejecting mechanism will now be described. As seen in FIGS. 5 and 6, an axially extending release pin 112 is slidably mounted in the boss 76 and is yieldably biased toward the free end of the boss by means of a helical spring 114. The release pin 112 is bored at 116 to carry a laterally extending locking pin 118. The release pin 112 is normally extended in the position shown in FIG. 5 under the influence of the helical compression spring 114. Under these circumstances the locking pin 118 is in an extended position with its outer end in a locking pin recess 80*c* (FIG. 6) in the locking ring 80. The locking pin 118 is located in a substantially larger, radially extending hole 77 at the base of the boss 76 and is free to move a short distance up and down within the hole 77. Whenever the locking ring 80 is turned in a counterclockwise direction on the boss 76 against the compression of springs 90, 92, the locking pin 118 will ultimately become aligned with the locking pin retaining slot 80*c* whereupon the spring 114 will force the release pin 112 and locking pin 118 axially of the punch, i.e. outwardly, so that the locking pin rests in the locking pin retaining slot 80*c* thereby holding the locking ring 80 temporarily in an "open" or "insert" position ready to receive the stripper plate 74.

The stripper plate can now be inserted with the orientation pin 74*c* in one of the slots 76*b*. As this is done, the rim 75 of the stripper plate 74 will strike the release pin 112, forcing it back into the boss 76 and as soon as the locking pin 118 has cleared the locking pin retaining slot 80*c*, the springs 90, 92 will quickly rotate the locking ring 80 to a locking position with the flanges 109 extending over the pins 74*d* to securely retain the stripper plate 74 in place. In this way it can be seen that the stripper plate can be very quickly and easily inserted with one hand and, upon being inserted, is automatically held in place by the automatic locking action of the locking ring 80 due to the retraction of release pin 112 and the consequent removal of the locking pin 118 from the slot 80*c*.

However, when the stripper plate 74 and punch 45 are to be removed, all that is necessary after loosening the drawbolt 56 is to again turn the locking ring 80 in a counterclockwise direction against the force of the springs 90, 92, allowing the locking pin 118 to snap up under the influence of spring 114 into the locking pin retaining slot 80*c*. As this happens the ejection spring 58 pops the punch 45 out, thereby automatically ejecting the stripper plate 74 with a snap action.

From the foregoing description it can be seen that the punch assembly 10 is self-contained. It is well suited for use in a high speed turret punch press of the type with a push-pull ram but can also be used, if desired, on a push style punch. The punch assembly 10 is supported for reciprocation in the turret bore by its outside surface and is oriented about its axis, i.e. prevented from rotating by the external key means 42. Within the punch assembly 10, the tang 12 is oriented by means of the key 68 and the operating end 46 of the punch 45 itself is oriented against both lateral motion and against turning about the axis of the punch by the stripper plate 74.

During operation of the punch press, the turret 34 is indexed conventionally so that the punch holder tang 12 enters the T-slot 16 of the ram 18. In the punching operation the ram moves downwardly, pushing the entire punch assembly 10 downwardly against the workpiece. When the stripper reaches the workpiece 40, it and the punch assembly 10 stop as the ram 18, tang 12 and punch 45 continue downwardly to pierce the workpiece 40. On the return stroke the ram 18 forcefully retracts the tang 12 and the punch 45 while the retraction springs 52 apply pressure to the workpiece via the stripper 74, holding it flat and securely in place, thereby stripping it reliably from the punch point 46.

It will also be seen that the punch 45 is guided in three locations: first, at its upper end by reason of the attachment of the tang 12 by means of the drawbolt 56, second, by means of the flange 45*a*, and third, by means of the sliding fit in the surrounding opening of the stripper plate 74. This is important because it distributes the loads more evenly throughout the punch and reduces wear, particularly when the punch is used for nibbling, an operation that produces substantial lateral stresses on the punch point. In addition, the punch is held against rotation in three ways: first, by the key 42 between the punch assembly and the turret; second, by the means of the key 68 between the tang 12 and the punch sleeve; and third, by means of the engagement between the stripper plate 74 and the punch point 46 (assuming that the punch point is other than circular in shape) or if it is circular, rotation at the free end of the punch is prevented by the engagement between the pin 45*b* and the keyway 45*c*.

It will also be noted that the action of stripping the work from the punch point 46 is accomplished by the spring 52. This achieves an effective stripping action while the position of the punch assembly itself is controlled by the ram 18.

It can also be seen that a single fastener, namely the drawbolt 56, is provided for maintaining a positive punch retention. In addition, fastener 56 is always kept in place ready for use. A further important advantage is provided in that by loosening the drawbolt 56 all the way the continued downward pressure produced by the ejection spring 58 will, when the drawbolt 56 is entirely out of the punch 45, cause the drawbolt 56 to make an audible clicking sound due to the last thread at the end of the drawbolt 56 raising the bolt repeatedly against the pressure of the ejection spring 58. This sound indicates that the punch is free and can be removed by drawing it through the lower end of the sleeve 48 after rotating the locking ring 80 to release the stripper 74.

As already described, the stripper plate is easy to remove and reinsert and the punch and stripper plate are ejected by the ejection spring 58 with a pop-out action to further facilitate rapid punch removal and replacement. The orientation pin 74*c* cooperating with the multiple slots 76*b* provides multiple position keying. In other words, the punch can be positioned in any one of eight angularly spaced apart positions about the axis of the punch to facilitate versatile use of the tooling.

Refer now to FIG. 9. The locking ring 80 is provided with a plurality of radial air ports 80*d* which during operation are aligned with the slots 76*b* so that the flange 45*a* acts as a piston or plunger in bore 71 causing the space within the bore 71 to change volume, thereby drawing air rapidly in and out through the air ports 80*d*, as best seen in FIG. 9, to provide cooling air for the punch point 46 as the chamber surrounding the punch point 46 changes volume. This helps to keep the punch point 46 cool and further lengthens its life.

Lubricating oil normally present around the ram 18 flows downwardly about the tang 12 and will flow next into an annular lubrication trough 67 which communicates with radially extending runoff slots 69 that enable a certain amount of lubrication to flow down over the outer surface of the sleeve 48 to provide ample lubrication between the punch assembly 10 and the turret bore 30. The remaining lubrication within the trough 67 will, during operation, flow downwardly through a lubrication channel such as spiral channel 13 (FIG. 2) and between the tang 12 and the bore 50 to provide lubrication at that point as well as to the retraction spring assembly 52 and the sliding engagement between the punch in the bore 71 and the punch point 46 in the stripper plate 74.

In this way the punch assembly of the present invention makes it more feasible to have all stations of the punch press filled to capacity with punches that are able to operate at high speed under either standard manual operation or computer automated control and indexing, i.e. with electronic data processing control capability.

It can also be seen that both the punch point 46 and the flange 45*a* are guided as well as the top of the punch which is guided by the tang to achieve stable, rigid and clean cutting action.

Many variations within the scope of the appended claims will be apparent to those skilled in the art once the principles described above are understood.

What is claimed is:

1. A punching assembly for a punch press or the like having an opening for the punch assembly, said punch assembly comprising a sleeve adapted to be mounted for sliding motion in the opening of the press, a punch slidably mounted in the sleeve for movement along a punch axis, means yieldably biasing the punch toward a first end of the sleeve, a stripper plate mounted at a second end of the sleeve, said stripper plate having an opening corresponding in shape to the shape of an operating end of the punch and being slidably engaged over the operating end of the punch to provide a sliding fit therefor, said stripper plate is provided with projections and a retaining member contains retaining elements adapted to cover the projections for holding the stripper plate in place and the retaining member is shiftable to a stripper plate releasing position wherein the retaining elements are out of alignment with the projections on the stripper plate.

2. The punch assembly of claim 4 wherein the punch has an end opposite said operating end of said punch, said opposite end of the punch is provided with a connection means for connecting the punch to a punch pres ram to achieve push-pull operation of the punch wherein the ram both pushes the punch downwardly and forcibly retracts the punch during each cycle of operation.

3. A punch assembly for a punch press comprising a punch sleeve, a punch slidably mounted therein, said punch having upper and lower end, said upper end of the punch having means adapted to engage a ram of the punch press for moving the punch, compression spring means operatively associated between the punch and the sleeve and a removable stripper plate slidably engaged upon the lower end of the punch which comprises an operating end of said punch, said stripper plate having at least one projection thereon and a shiftable locking member mounted upon the sleeve and including a retaining extension engaged over the projection to hold the stripper plate in place, and the locking member being movable on the end of the sleeve so that the retaining extension is movable to a position out of alignment with the projection allowing the stripper plate to be thereby removed.

4. The apparatus of claim 3 wherein the locking member is a ring mounted for rotation upon the sleeve adjacent to the stripper plate and the locking ring is rotated to misalign the retaining extension with respect to the projection on the stripper plate to facilitate the removal thereof.

5. The device of claim 4 wherein said projection comprises a plurality of laterally extending, circumferentially spaced apart projections on the stripper plate, the locking member is a ring having a plurality of circumferentially spaced pin receiving slots, and the retaining extension comprises centrally extending flanges on the locking ring between the slots for covering the projections on the stripper plate to thereby retain the stripper plate in place on the punch assembly.

6. The apparatus of claim 3 wherein the locking member is a ring and the ring is yieldably biased in a selected direction of rotation upon the punch assembly to maintain the stripper plate retaining extensions in a position covering the projections on the stripper plate to retain the stripper plate in place, but upon manual rotation thereof, the pin receiving slots can be aligned with the projections on the stripper plate to thereby release the plate.

7. The punch assembly of claim 3 including locating means operatively associated between the stripper plate and the punch assembly for orienting the stripper plate in any one of a plurality of circumferentially spaced apart angularly related positions around a central longitudinal axis of the punch.

8. The punch assembly of claim 7 wherein eight such positions are provided in the punch assembly and a locating member is provided on the stripper for insertion into an opening at any one of said positions.

9. A punch assembly for a punch press comprising a punch sleeve, a punch slidably mounted therein, said punch having upper and lower ends, said upper end of the punch being adapted to engage a ram of the punch press, compression spring means operatively associated between the punch and the sleeve and a stripper plate removably mounted on the lower end of the punch, said stripper plate having at least one projection thereon, a stripper plate locking ring rotatably mounted on the sleeve adjacent the stripper plate including at least one member for engaging the stripper plate to hold the stripper plate in place on the punch assembly, a release pin slidably mounted in the punch assembly for engagement with the stripper plate and a locking pin connection to the release pin, a locking pin retaining slot in the locking ring, a spring for extending the release pin toward the stripper plate whereby insertion of the stripper plate will move the locking pin out of the locking pin retaining slot in the locking ring allowing the locking ring to rotate on the punch assembly to a position in which the retaining means overlaps the projection on the stripper plate and upon rotation of the locking ring to a position aligning the locking pin retaining slot with the locking pin, allowing the ejection spring to pop the punch outwardly to forcibly eject the stripper plate from the punch assembly.

* * * * *